US007048637B2

(12) United States Patent
McDonald

(10) Patent No.: US 7,048,637 B2
(45) Date of Patent: May 23, 2006

(54) GOLF GRIP ALIGNMENT DEVICE

(76) Inventor: James R. McDonald, 2470 Winesap, Broadview Heights, OH (US) 44147

( * ) Notice: Subject to any disclaimer, the term of this patent is extended or adjusted under 35 U.S.C. 154(b) by 0 days.

(21) Appl. No.: 10/689,287

(22) Filed: Oct. 20, 2003

(65) Prior Publication Data

US 2004/0242341 A1 Dec. 2, 2004

Related U.S. Application Data

(60) Provisional application No. 60/420,215, filed on Oct. 22, 2002.

(51) Int. Cl.
*A63B 69/36* (2006.01)

(52) U.S. Cl. ..... 473/203; 473/206

(58) Field of Classification Search ..... 473/300–303, 473/201–204, 206
See application file for complete search history.

(56) References Cited

U.S. PATENT DOCUMENTS

| | | | | |
|---|---|---|---|---|
| 4,065,127 | A | | 12/1977 | Fagan |
| 4,103,896 | A | | 8/1978 | Lorang |
| 4,361,326 | A | | 11/1982 | Kokes |
| 4,365,807 | A | | 12/1982 | Melby |
| 4,776,595 | A | | 10/1988 | Wilkins |
| 4,869,511 | A | * | 9/1989 | Spoonster, Sr. ..... 473/203 |
| 4,878,667 | A | * | 11/1989 | Tosti ..... 473/204 |
| 4,930,785 | A | | 6/1990 | Mills |
| 4,981,297 | A | | 1/1991 | Foster |
| 5,018,734 | A | | 5/1991 | Allsop |
| 5,163,685 | A | | 11/1992 | Rhodes |
| 5,219,458 | A | | 6/1993 | Bencriscutto |
| 5,232,225 | A | | 8/1993 | Snyder |
| 5,335,908 | A | * | 8/1994 | Bamber ..... 473/317 |
| 5,427,376 | A | * | 6/1995 | Cummings et al. ..... 473/201 |
| 5,441,270 | A | | 8/1995 | Williams |
| 5,462,280 | A | | 10/1995 | Dickerson |
| 5,626,527 | A | | 5/1997 | Eberlein |
| 5,803,821 | A | | 9/1998 | Lupinacci |
| 5,984,795 | A | * | 11/1999 | Stafford ..... 473/206 |
| 6,022,278 | A | | 2/2000 | Vela |
| 6,540,621 | B1 | * | 4/2003 | Robinson ..... 473/201 |

OTHER PUBLICATIONS http://www.thumbcaddy.com/thumb_caddy_home.htm.

* cited by examiner

*Primary Examiner*—Stephen Blau
(74) *Attorney, Agent, or Firm*—Fay, Sharpe, Fagan, Minnich & McKee, LLP

(57) ABSTRACT

A golf grip alignment device includes a body adapted to fit onto a golf club. The a body includes a tab extending from the body and a seat defined on the body. The tab includes a surface adapted to receive the golfer's thumb. The seat is adapted to receive the golfer's index finger.

14 Claims, 6 Drawing Sheets

GOLF GRIP ALIGNMENT DEVICE

This application claims priority under 35 U.S.C. §119(e) to U.S. provisional patent application Ser. No. 60/420,215, filed Oct. 22, 2002, which is incorporated herein by reference.

BACKGROUND OF THE INVENTION

The present invention relates to a device for use on a golf club in an effort to enable the golfer to obtain better control of the golf club. More particularly, the device is directed toward an attachment to fit over a grip and/or handle of a golf club to ensure a proper gripping of the golf club by a golfer when swinging the club.

Various attachments have been provided for use on a golf club in an effort to enable the golfer to obtain better control of the club. Some examples include grip attachments that cover substantially the entire golf club grip. Such attachments can adhesively affix to the golf club grip. These grip attachments can also affix to the grip via a friction fit. Such attachments can also be made of an elastic material that can stretch over the grip and attach to the grip through the energy provided by the elastic material. These attachments can be difficult to attach to and remove from the golf club.

Other such golf grip aiding devices include items that attach both to the golfer's hand and the golf club. These attachments can be complicated to use. A novice golfer can have difficulty aligning such a device for proper use on the golf club.

Accordingly, it is desirable to provide a golf grip alignment device that easily attaches to a golf club grip and/or handle. It is also desirable to provide a golf grip alignment device that is easily removable from the golf grip. It also desirable to provide such a device that is simple to align on the golf club. It is also desirable to provide a golf grip alignment device that is inexpensive and easy to manufacture.

SUMMARY OF THE INVENTION

A golf grip alignment device that fits onto a golf club includes a first portion and a second portion attached to one another at a hinge. A tab extends from at least one of the first portion and the second portion. At least one of the first portion and the second portion defines a seat. The tab includes a surface adapted to receive the golfer's thumb. The seat is adapted to receive the golfer's index finger.

A golf grip alignment device includes a body adapted to fit onto a golf club. The a body includes a tab extending from the body and a seat defined on the body. The tab includes a surface adapted to receive the golfer's thumb. The seat is adapted to receive the golfer's index finger.

A method of aligning a user's grip on a golf club includes attaching a golf grip alignment device onto a handle of a golf club, gripping the golf club, swinging the golf club, and striking a golf ball with the golf club. Where the golf ball travels an undesired path, i.e. a hook or a slice, the method further includes adjusting the position of the golf grip alignment device and repeating the steps of gripping the golf club, swinging the golf club, and striking a golf ball with the golf club until the golf ball travels desired path.

DETAILED DESCRIPTION OF THE INVENTION

Figure 1:
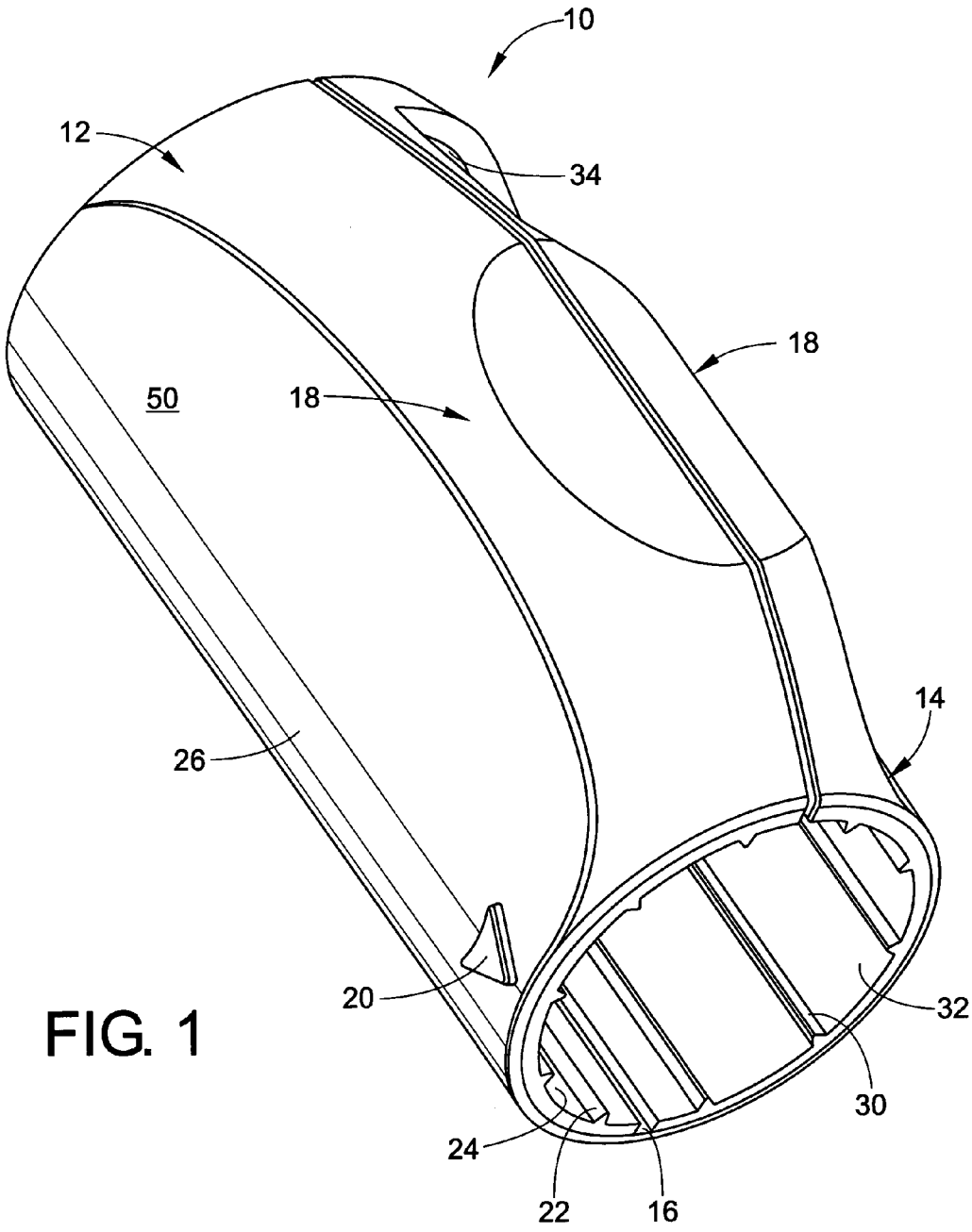
FIG. 1 is a perspective view of a golf grip alignment device.

A golf grip alignment device includes a body 10 having a first end 12 and a second end 14. The body 10 generally has a clam shell configuration and is adapted to fit onto the handle or grip of a golf club (not shown) such that the first end 12 is towards the head of the golf club and the second end 14 is towards the butt end of the golf club. When in a closed position the body 10 is substantially cylindrical in shape. The body 10 can be somewhat tapered so that it can more easily fit on a tapered golf club grip. The body 10 is made of a durable material, such as, but not limited to plastic.

The body 10 includes a first portion 16 and a second portion 18 connected to one another at a hinge 22. The first portion 16 can comprise more than half of the body of the device. Likewise the second portion 18 can comprise more than half of the body. The body 10 also includes a tab 24 and a seat 26, which will be described more particularly below.

Figure 2:
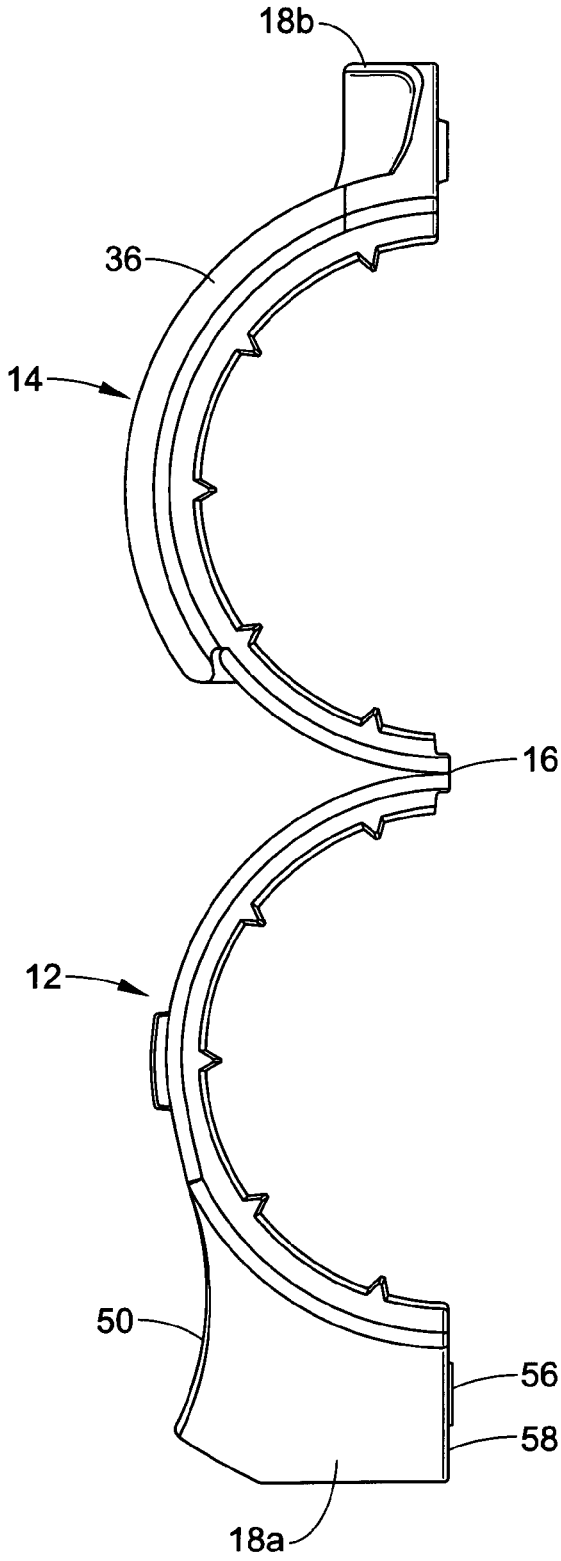
FIG. 2 is an end elevation view of the device of FIG. 1 with the device in an open position from an end of the device closer to the head of a golf club when the device is attached to the golf club.

As seen in FIG. 2, the first portion 16 has a semi-circular shape in radial cross-section. The first portion 16 includes ridges 28 on an inner surface 32. The ridges are slip resisting members for the body 10. The ridges engage the handle grip of the golf club to resist against the club with respect to the body 10, or vice versa, during the swing or upon impact of the golf ball. In the preferred embodiment, the ridges are axially aligned. In an alternative embodiment the ridges can be radial or of spiral configuration. The ridges are triangular in a radial cross-section. In an alternative embodiment the ridges could be rectangular, rounded, or any other shape. In another embodiment, the ridges can be replaced with small bumps or the like disposed on the inner surface. Likewise, the ridges can be replaced with any structure that can provide slip resistance to the alignment device when it is attached to the golf club grip.

The second portion 18 has a similar and complementary shape, i.e. semi-circular shape in cross-section, to the first portion 16. The second portion includes ridges 34 disposed on an inner surface 36. The ridges also provide slip resistance for the alignment device and are similar in configuration to the ridges 28 on the first portion 16.

Figure 3:
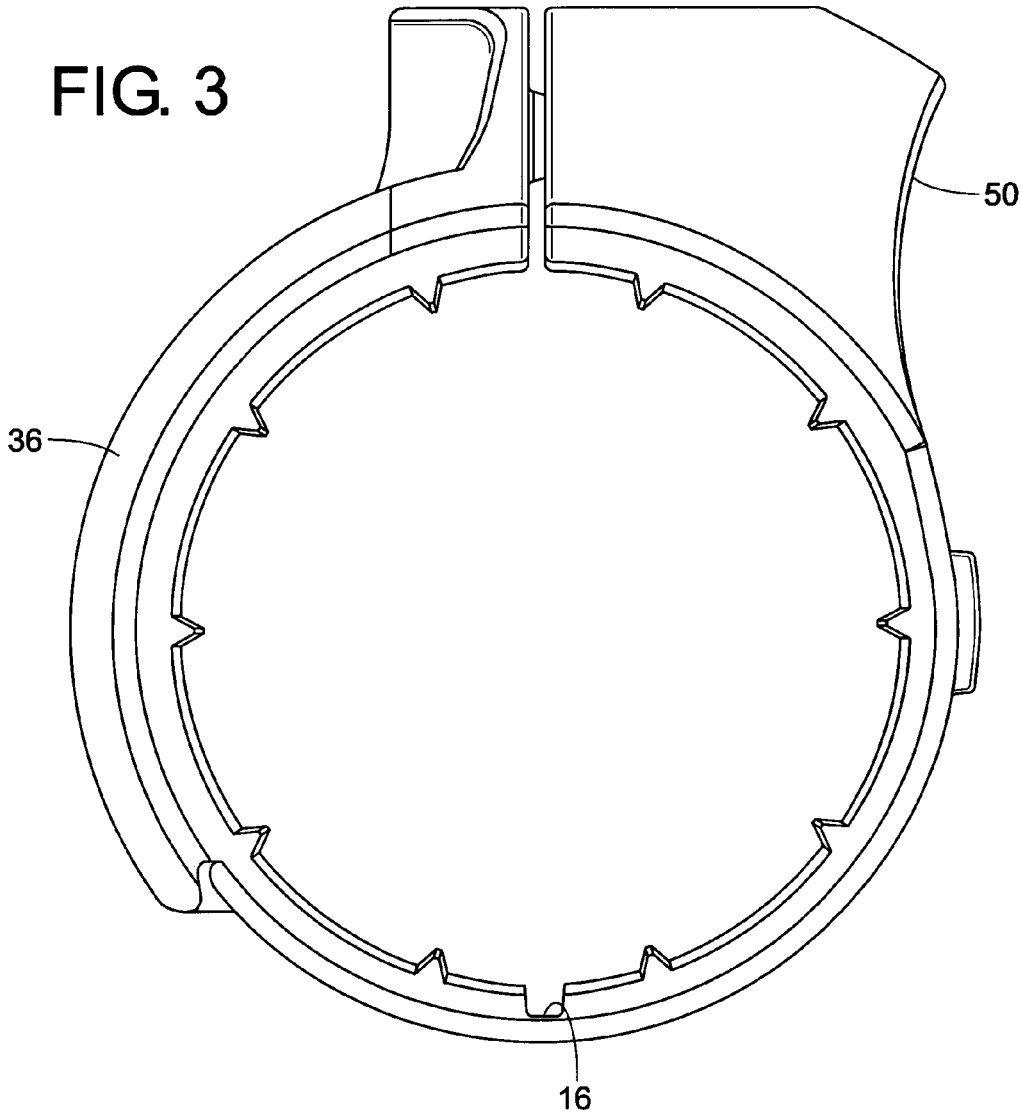
FIG. 3 is an end elevation view of the device of FIG. 1 with the device in a closed position from an end of the device closer to the head of a golf club when the device is attached to the golf club.

The hinge 22 interconnects the first portion 16 to the second portion 18. The term hinge is a generic term referring to any interconnection between the first portion 16 and the second portion 18 that allows the body to open. With reference to FIG. 3, the hinge 22 is depicted opposite the tab 24; however, the hinge can be positioned elsewhere on the body 10. The hinge allows for a one-piece alignment device benefiting the golfer in that he has only one item to attach to the golf club. Furthermore, the one-piece device eases manufacture of the device. The hinge also allows for easy attachment to the golf grip. Nevertheless, the alignment device could be designed without a hinge. In such an alternative embodiment, the body 10 could simply snap over the golf club grip. The body, in this alternative embodiment, can be made of resilient material that snaps over the golf club handle. The device could be made of two pieces or a plurality of pieces. The preferred device, however, includes the hinge.

Referring to FIG. 3, the tab 24 extends from the body 10. The tab 24 is located approximately 180° from the hinge 22 when the body 10 is closed. In the embodiment depicted, the tab 24 spans both the first portion 16 and the second portion 18. A first portion 24*a* of the tab 24 is disposed on the first portion 16. A second portion 24*b* of the tab is disposed on the second portion 18. The tab 24 includes a concave surface 38 on the first portion 16 that receives the golfer's thumb when the body is attached to the golf club and the golfer grips the club. The surface 38 spans substantially the entire axial dimension of the body 10.

Figure 4:
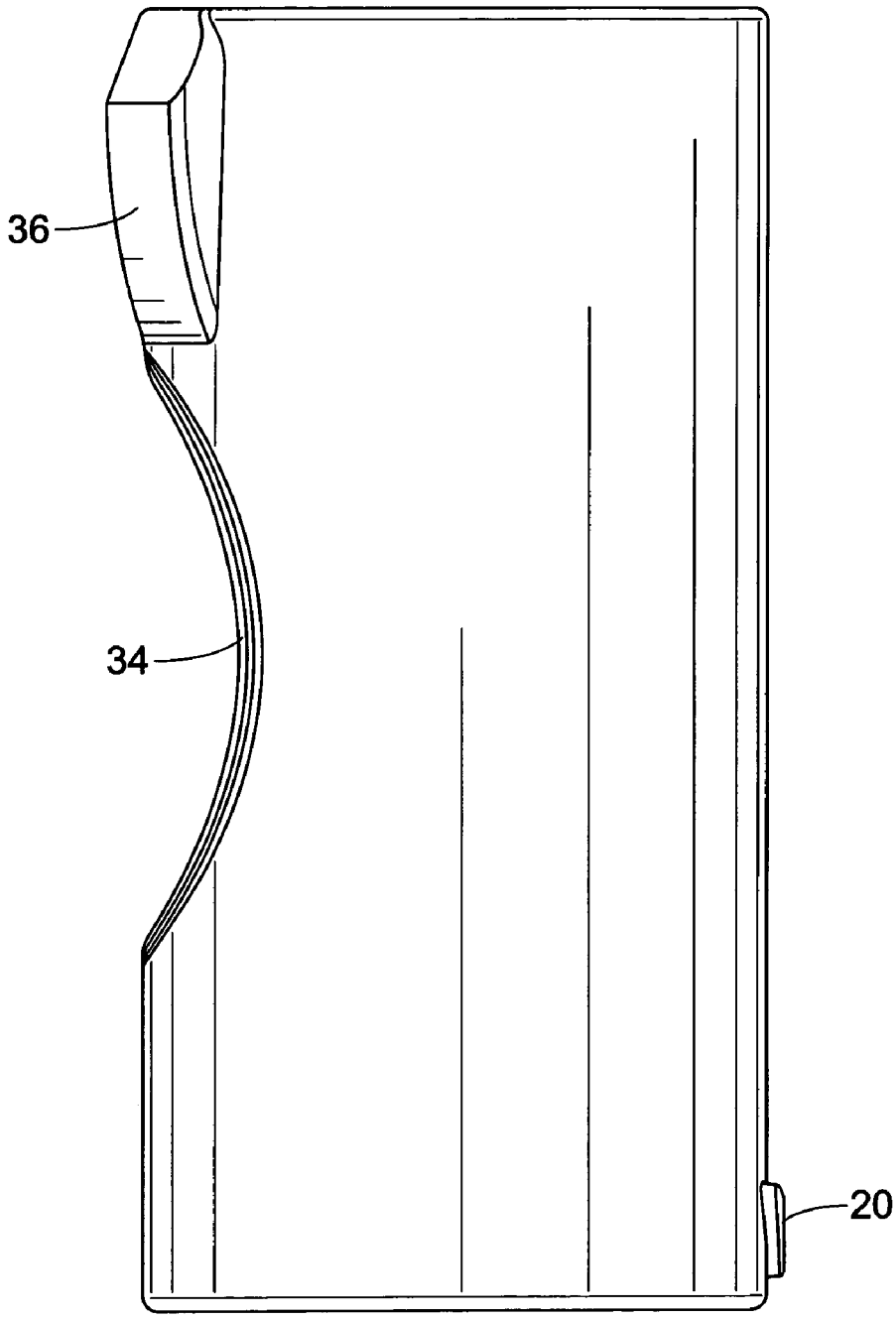
FIG. 4 is a side elevation view of the device of FIG. 1.

The seat 26 is positioned on the body 10 opposite the concave surface 38 of the tab 24, which in the embodiment depicted places the seat on the second portion 18. Referring to FIG. 4, the seat 26 includes a recessed area 40 that receives the golfer's index finger when the body is attached to the golf club and the golfer grips the club. As more clearly seen in FIG. 5, the seat 26 includes an opening 42. The opening is centrally located along a longitudinal axis of the body 10. The opening is substantially elliptical. The opening can provide a seat for at least one of the golfer's fingers and preferably the index finger. Furthermore the opening aids the golfer in achieving proper grip alignment of the golf club.

Figure 6:
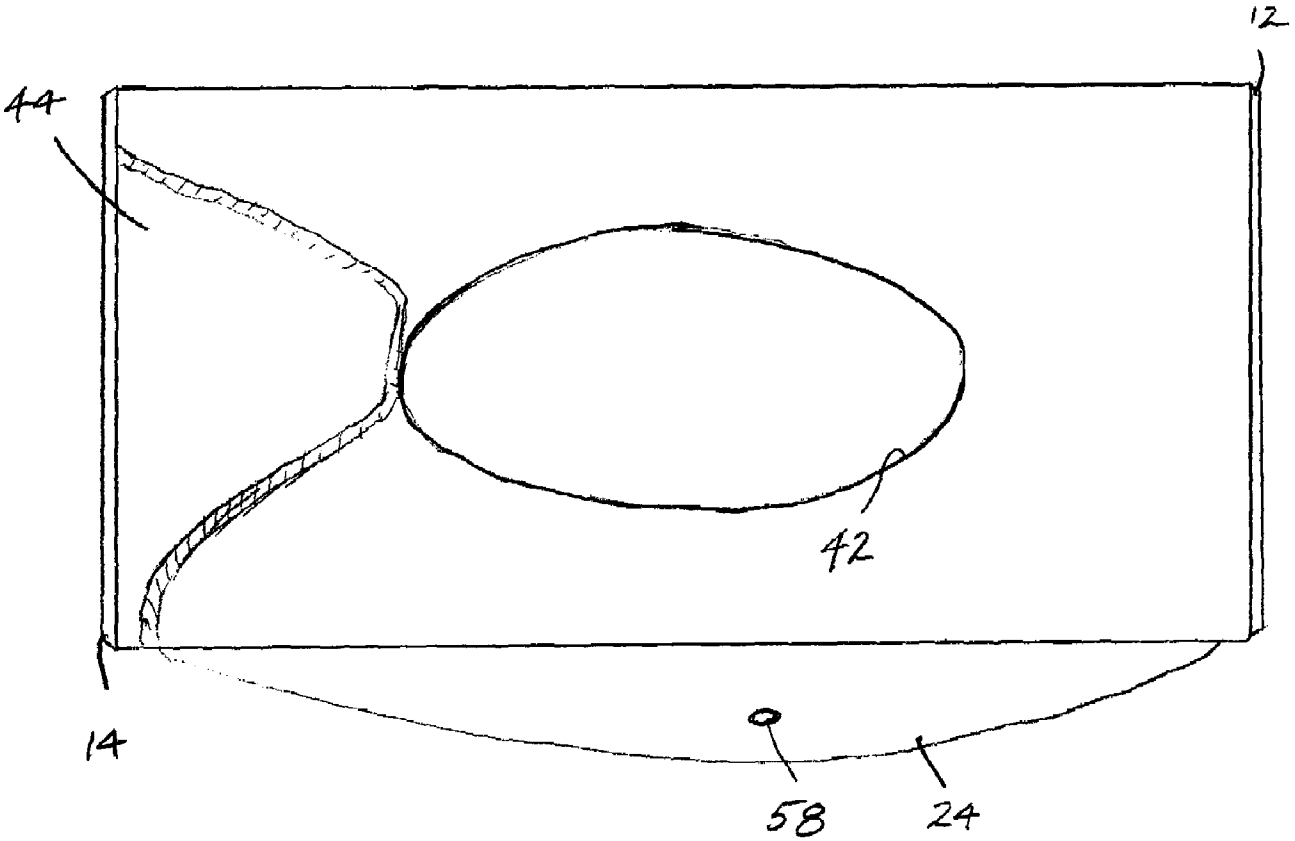
FIG. 6 is a plan view of the device of FIG. 1 showing an opening and protuberance of the device.

As more clearly seen in FIG. 2, the second portion 18 includes a protuberance 44 adjacent the seat 26. The protuberance 44 protrudes upwardly from the body from near the second end 14 of the body 12 to the opening 42, as seen in FIG. 4. Referring to FIG. 6, the protuberance 44 is generally tradezoidal in shape, where the narrow portion of the protuberance is positioned near the opening 42 and the wider portion of the protuberance is positioned near the second end 14 of the body. The protuberance extends into the tab 24 on the second portion 18 of the body, further defining the seat 26. The protuberance is spaced from the tab 24 such that the index finger rests in the seat 26 surrounded by the tab and the protuberance. The protuberance sets the golfer's index finger in the correct position and can also stop the index finger from sliding.

An indicator 46 is located approximately 90° from the tab 24 and 180° from the opening 42 when the body is closed. The indicator in the preferred embodiment is an arrow on an outer surface of the first portion 16. The indicator facilitates proper alignment of the body 10 on a golf club grip or handle. The indicator can also take form in other shapes such as, but not limited to, a line, a notch, a picture, etc.

Figure 5:
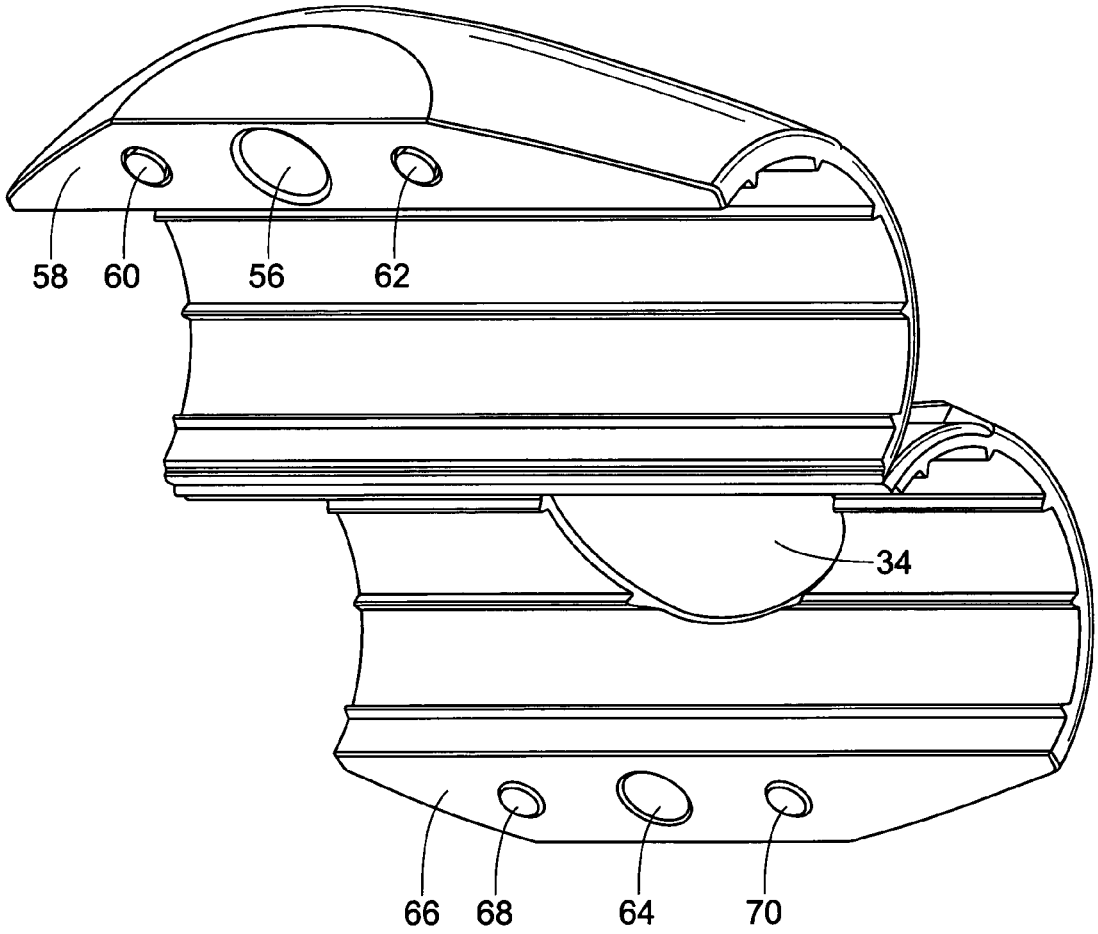
FIG. 5 is a perspective view of the alignment device of FIG. 1 showing the device in an opened position.

The tab 24 also includes a latching mechanism to close the body 10. Referring to FIG. 5, the first tab portion 24*a* includes a large central opening 52 and smaller openings 54 and 56 disposed on opposite sides of the central opening 52. The second tab portion 24*b* includes a large central opening 58 aligned with the central opening 52. The central opening 52 is threaded so that a conventional fastener is received by the central openings 52 and 58 to close the body 10. Protrusions 62 and 64 align with and are received by openings 54 and 56 when the body 10 is closed. In addition to the latching mechanism disclosed, any conventional latching mechanism can be used to attach the first portion 16 to the second portion 18, including a conventional latch, Velcro®, snaps, or the like.

In use, the body 10 is opened to surround a golf grip of a golf club. The indicator 46 is aligned along the shaft of the golf club such that the face of the golf club is perpendicular to a golf ball to be struck. The body 10 is then closed around the golf grip. A right handed golfer will place the golfer's right thumb in the concave surface 38. The golfer will also place the golfer's right index finger in the seat 26. The positioning of the concave surface 38 and the seat 26 ensures that the golfer has properly aligned the golfer's hands when gripping the golf club. Use by a right-handed golfer has been described; however, the alignment device can be used by a left handed golfer as well. An alignment device for a left-handed golfer would have concave surface 38 on an opposite side of the indicator 46.

The compact overall shape of the device provides a golf club alignment device that easily fits onto a number of different clubs. Furthermore, the size and shape of the device is designed to facilitate easy entry and removal of the club from a golf bag. The device reduces twisting of the club head during the back swing and during impact with the ball, particularly on off-center hits. The clam shell shape of the body allows the device to be easily removed and mounted onto different golf clubs. Furthermore, the clam shell shape of the body allows the device to be easily vertically adjusted along the grip of the golf club. The simple one piece design also provides for easy manufacture.

A golf grip alignment device has been described with reference to the preferred embodiments. Obviously, modifications and alterations will occur to others upon reading and understanding the preceding detailed description. It is intended that the invention be construed as including all such modifications and alterations that come within the scope of the appended claims.

What is claimed is:

1. A golf club grip alignment apparatus comprising a body having a generally cylindrical shape:

a first portion including a tab extending radially from said body and having a longitudinal axis generally parallel to the longitudinal axis of the body, said tab having a surface adapted to receive a thumb;

a second portion having a recessed seat adapted to receive an index finger;

a hinge connecting said first portion to said second portion; and said body being sized to removably attach to an elastomeric golf club grip.

2. The golf grip alignment device of claim 1, wherein said second portion defines an opening.

3. The golf grip alignment device of claim 2, wherein the opening is substantially elliptical.

4. The golf grip alignment device of claim 1, wherein said surface is concave.

5. The golf grip alignment device of claim 1, further comprising an attachment mechanism to selectively attach said first portion to said second portion.

6. The golf grip alignment device of claim 5, wherein said attachment mechanism includes components attached to said tab.

7. The golf grip alignment device of claim 1, further comprising an indicator disposed on at least one of said first and second portion.

8. The golf grip alignment device of claim 7, wherein said indicator comprises an arrow.

9. The golf grip alignment device of claim 1, further comprising a protuberance disposed adjacent the recessed seat, said protuberance shaped to accommodate a bent index finger.

10. The golf grip alignment device of claim 1, further comprising slip resisting members extending from an inner surface of said first portion.

11. A golf grip alignment device comprising a body adapted to fit over a golf club grip and including a tab adapted to receive a thumb and extending from the body and a recessed seat adapted to receive an index finger on a generally opposed side of the body from said tab, wherein a remainder of a hand is substantially not in contact with said device, the seat defining an opening in said body and the device further comprising a hinge that attaches a first portion of said body to a second portion of said body.

12. The golf grip alignment device of claim 11, further comprising an indicator disposed adjacent the tab.

13. The golf grip alignment device of claim 11, wherein said body has a substantially cylindrical configuration.

14. The golf grip alignment device of claim 11, further comprising an attachment mechanism that selectively attaches a first portion of said body to a second portion of said body.

* * * * *